US008142574B2

(12) United States Patent
Kiyose et al.

(10) Patent No.: US 8,142,574 B2
(45) Date of Patent: Mar. 27, 2012

(54) STEEL PRODUCT FOR WELDING

(75) Inventors: Akihito Kiyose, Tokyo (JP); Hideaki Yamamura, Tokyo (JP); Tooru Matsumiya, Tokyo (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 12/995,394

(22) PCT Filed: Jul. 15, 2009

(86) PCT No.: PCT/JP2009/062836

§ 371 (c)(1),
(2), (4) Date: Nov. 30, 2010

(87) PCT Pub. No.: WO2010/008031

PCT Pub. Date: Jan. 21, 2010

(65) Prior Publication Data

US 2011/0091347 A1 Apr. 21, 2011

(30) Foreign Application Priority Data

Jul. 15, 2008 (JP) ..... P2008-183745

(51) Int. Cl.
*C22C 38/00* (2006.01)
*C22C 38/08* (2006.01)

(52) U.S. Cl. ..... 148/320; 148/328; 148/332; 148/336; 420/8; 420/89; 420/92

(58) Field of Classification Search ..... 148/320, 148/328, 332, 336; 420/8, 89, 92
See application file for complete search history.

(56) References Cited

U.S. PATENT DOCUMENTS 6,344,093 B1 * 2/2002 Ohmori et al. ..... 148/320

FOREIGN PATENT DOCUMENTS

| | | | | |
|---|---|---|---|---|
| EP | 1 262 571 | A1 | | 12/2002 |
| JP | 2000-80436 | A | | 3/2000 |
| JP | 2001-20031 | A | | 1/2001 |
| JP | 2001-335882 | A | * | 4/2001 |
| JP | 2001-335882 | A | | 12/2001 |
| JP | 2001-342537 | A | | 12/2001 |
| JP | 2002-309338 | A | | 10/2002 |
| JP | 2003-226936 | A | | 8/2003 |
| JP | 2004-76085 | A | | 3/2004 |
| JP | 2007-31749 | A | | 2/2007 |

OTHER PUBLICATIONS

"International Search Report, dated, Oct. 6, 2009, issued in PCT/JP2009/062836".
Eiji Ichise, "On the Minimum Appears on the Al—O—Al2O3 Equilibrium Concentration Curve", The Iron and Steel Institute of Japan, Tetsu-to-Hagane, 1991, vol. 77, pp. 197-200.

* cited by examiner

*Primary Examiner* — Sikyin Ip
(74) *Attorney, Agent, or Firm* — Birch, Stewart, Kolasch & Birch, LLP

(57) ABSTRACT

A steel product for welding includes the following component: by mass %, C: 0.3% or less, Si: 0.5% or less, Mn: 0.3~2%, P: 0.03% or less, S: 0.03% or less, Al: 0.3~5%, O: 0.003~0.01%, and N: 0.006% or less; wherein the balance is composed of Fe and inevitable impurities; wherein Al-containing oxides having a size of 0.005 to 0.05 μm are dispersed in steel at a ratio of $1\times10^6/mm^2$ or more.

2 Claims, 1 Drawing Sheet

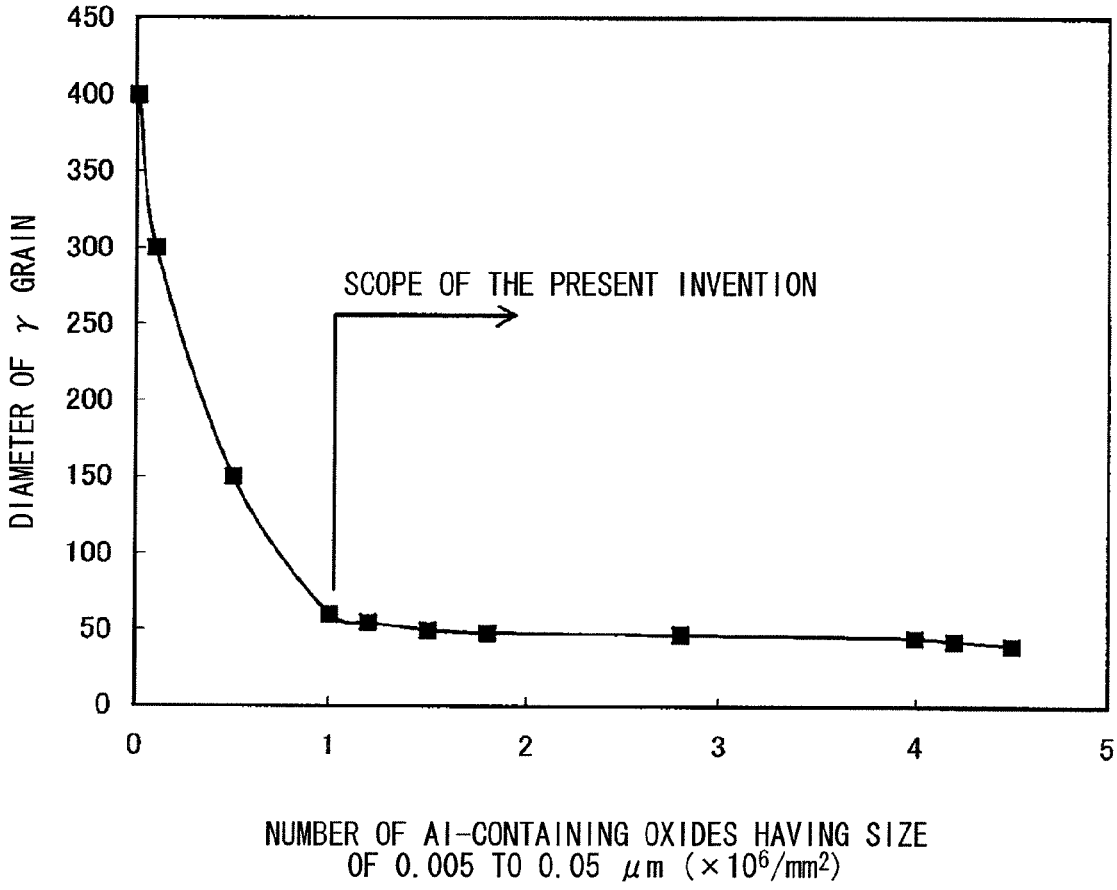
450
400
350
300
250
200
150
100
50
0
DIAMETER OF γ GRAIN
SCOPE OF THE PRESENT INVENTION
0
1
2
3
4
5
NUMBER OF Al-CONTAINING OXIDES HAVING SIZE
OF 0.005 TO 0.05 μm (×10⁶/mm²)

STEEL PRODUCT FOR WELDING

BACKGROUND OF THE INVENTION

1. Field of the Invention

The present invention relates to a steel product for welding which has excellent toughness in a heat affected zone (hereinafter, referred to as "HAZ"). Since the steel product for welding according to the present invention has good HAZ toughness under a wide range of welding conditions including low heat input welding to ultra high heat input welding, the steel product for welding according to the present invention is used for various welded steel structures such as buildings, bridges, ships, vessels, line pipes, construction machines, marine structures and tanks.

Priority is claimed on Japanese Patent Application No. 2008-183745, filed on Jul. 15, 2008, the content of which is incorporated herein by reference.

2. Description of Related Art

In a HAZ, the nearer a fusion line is, the higher the heating temperature during the welding process is. Accordingly, in an area near the fusion line which is heated to 1400° C. or higher, austenite (hereinafter, referred to as γ) becomes markedly coarse. As a result, the HAZ structure after cooling becomes coarse and toughness deteriorates. This tendency appears prominently as the welding heat input amount increases.

As means for solving the problems, there is a steel product in which fine TiN is dispersed, as disclosed in Japanese Unexamined Patent Application, First Publication No. 2001-20031, a steel plate in which a large amount of TiN is dispersed and which contains fine oxides composed of Mg and Al as disclosed in Japanese Unexamined Patent Application, First Publication No. 2000-80436, a steel product in which fine Al-containing oxides are dispersed, as disclosed in Japanese Unexamined Patent Application, First Publication No. 2004-76085, a steel product in which elements decreasing oxygen activity are added and a large amount of Mg-containing oxides are dispersed, as disclosed in Japanese Unexamined Patent Application, First Publication No. 2001-335882, and the like.

However, the above methods have the following problems.

In the steel product described in Japanese Unexamined Patent Application, First Publication No. 2001-20031, TiN having a equivalent circular diameter of 0.05 μm or less is dispersed at a ratio of $1\times10^3/mm^2$ or more and TiN having a equivalent circular diameter of 0.03 to 0.20 μm is dispersed at a ratio of $1\times10^3/mm^2$ to less than $1\times10^5/mm^2$ in steel. However, in high heat input welding where the residence time at high temperatures equal to or higher than 1400° C. is long, fine TiN contributing to the suppression of the growth of the γ grains is dissolved in steel and is disappeared. Accordingly, the γ grains become coarse and toughness in the HAZ deteriorates.

In the steel plate described in Japanese Unexamined Patent Application, First Publication No. 2000-80436, TiN having a size of 0.01 to less than 0.5 μm, which contains oxides composed of Mg and Al, exist at a ratio of $10,000/mm^2$ or more. The steel plate has excellent HAZ toughness in high heat input welding where the welding heat input amount is in the range of 20 to 100 kJ/mm. However, since the growth of γ grains in a HAZ cannot be suppressed in ultra high heat input welding where the welding heat input amount exceeds 100 kJ/mm, the toughness in the HAZ is lowered.

In the steel product described in Japanese Unexamined Patent Application, First Publication No. 2004-76085, Al-containing oxides having a size of 0.05 to 0.2 μm are dispersed at a ratio of $10,000/mm^2$ or more in steel. Accordingly, the steel product has excellent HAZ toughness in high heat input welding where the welding heat input amount is in the range of 20 to 100 kJ/mm. However, since the growth of γ grains in a HAZ cannot be suppressed in ultra high heat input welding where the welding heat input amount exceeds 100 kJ/mm, the toughness in the HAZ is lowered.

In the steel described in Unexamined Patent Application, First Publication No. 2001-335882, oxide-nitride composite particles having a size of 0.01 to 2.0 μm are included at a ratio of $1.0\times10^5/mm^2$ to $1.0\times10^8/mm^2$ in steel. The oxide-nitride composite particles are composed of MgO or Mg-containing oxides of 0.005 to 0.1 μm as nuclei and nitrides including oxides or nitrides precipitated around oxides. The steel has excellent HAZ toughness in high heat input welding where the welding heat input amount is 90 kJ/mm. However, since the growth of γ grains in a HAZ cannot be suppressed in ultra high heat input welding where the welding heat input amount exceeds 100 kJ/mm, the toughness in the HAZ is lowered.

SUMMARY OF THE INVENTION

In view of this, an object of the present invention is to provide a steel product for welding, in which the growth of γ grains in a HAZ is suppressed by more uniformly dispersing finer oxides than in the conventional techniques and which has excellent HAZ toughness even in ultra high heat input welding where the welding heat input amount exceeds 100 kJ/mm.

The main points of the present invention are as follows.

(1) A steel product for welding includes the following component: by mass %, C: 0.3% or less, Si: 0.5% or less, Mn: 0.3~2%, P: 0.03% or less, S: 0.03% or less, Al: 0.3~5%, O: 0.003~0.01%, and N: 0.006% or less; wherein the balance is composed of Fe and inevitable impurities; wherein Al-containing oxides having a size of 0.005 to 0.05 μm are dispersed in steel at a ratio of $1\times10^6/mm^2$ or more.

(2) The steel product for welding according to (1), wherein the steel product for welding includes one or more of the following component: by mass %, Cu: 0.3~2%, and Ni: 0.3~2%.

When steel product for welding according to the present invention is used, HAZ toughness does not deteriorate even in ultra high heat input welding where the welding heat input amount exceeds 100 kJ/mm, and thus high heat input welding can be performed with high efficiency.

BRIEF DESCRIPTION OF THE DRAWINGS

FIG. 1 is a diagram showing the influence of the number of Al-containing oxides having a size of 0.005 to 0.05 μm on the diameter of γ grains.

DETAILED DESCRIPTION OF THE INVENTION

The present inventors have eagerly examined on a condition for dispersing a large amount of fine oxides which are thermally stable at high temperatures in steel in order to improve toughness in a HAZ. As a result, it was found that, when oxygen activity is decreased by increasing the concentration of Al in molten steel and the molten steel having an oxygen concentration increased in this manner is solidified, a large amount of fine alumina is dispersed in the steel. A detailed description will be given as follows.

The oxides generated by the deoxidation, which is performed by adding a deoxidizing element to molten steel, are easily grown because elements are rapidly diffused in the molten steel. For this reason, it is difficult to maintain fine oxides having a size less than 0.1 μm. Further, since the oxides are easily aggregated or coalesced, the oxides generated by the deoxidation easily become coarse.

From this, an attention was paid to means which rarely generated oxides in molten steel but generated oxides in the steel during the solidification of the molten steel or after the solidification. That is, it was investigated that molten steel is solidified in conjunction with the generation of oxides in order to suppress the growth of the oxides by the solidification so that the fine oxides are dispersed in the steel.

In order to disperse a large amount of fine oxides, it is necessary to increase the concentrations of oxygen and a deoxidizing element immediately before molten steel is solidified. It is known that the oxygen concentration in molten steel is decreased and then increases while the concentration of a deoxidizing element in the molten steel increases (for example, Ichise, Eiji: Tetsu-to-Hagané, 77 (1991), p. 197). When using this phenomenon, it is possible to increase the concentrations of oxygen and a deoxidizing element.

As a result of such an examination, the following fact was newly found. When molten steel is solidified in which the concentrations of oxygen and a deoxidizing element are increased, oxides are formed by a reduction in the solubility product of a deoxidation product in accordance with a reduction in temperature and an increase of a solute element in the residual molten steel. However, the oxides are immediately captured in the solidified steel when growth, aggregation or coalescence occurs. Accordingly, extremely fine oxides can be dispersed in steel.

Specifically, on the basis of Table 1, the concentration of Al in steel was variously changed and the number of fine Al-containing oxides was checked. As a result, it was found that the number of Al-containing oxides in steel after the solidification markedly increases when the concentration of Al in molten steel is equal to or more than 0.3% by mass. It was also found that an equivalent circular diameter of the generated Al-containing oxides is 0.005 to 0.05 μm and the number of Al-containing oxides per unit area is equal to or more than $10^6/mm^2$ The reason why the chemical composition of the steel of the present invention is limited will be described below. Hereinafter, % represents % by mass.

C: 0.3% or less

C is indispensable as a basic element improving the strength of the base material of steel. However, when C is extremely contained at an amount greater than 0.3%, the toughness and weldability of the steel product may deteriorate. Therefore, the upper limit of the amount of C to be contained is set to 0.3%. Accordingly, the upper limit of the amount of C to be contained is set to 0.3% and the lower limit of the amount to be contained is not 0%.

Si: 0.5% or less

Si is an essential element to secure the strength of the base material. However, when Si is contained at an amount greater than 0.5%, the toughness in the HAZ may deteriorate. Therefore, the upper limit of the amount of Si to be contained is set to 0.5% and the lower limit of the amount to be contained is not 0%.

Mn: 0.3 to 2%

Mn is an essential element to secure the strength and toughness of the base material. In order to secure such effects, it is necessary to add Mn in an amount equal to or more than 0.3%. However, when Mn is contained at an amount greater than 2%, the toughness in the HAZ considerably deteriorates. Therefore, the amount of Mn to be contained is equal to or less than 2%.

P: 0.03% or less

P is an element which affects the toughness of steel. When P is contained at an amount greater than 0.03%, the toughness of a steel product considerably deteriorates. Therefore, the amount of P to be contained is set as equal to or less than 0.03% and the lower limit of the amount to be contained is 0%.

S: 0.03% or less

S is an element which affects the toughness of steel. When S is contained at an amount greater than 0.03%, the toughness of a steel product considerably deteriorates. Therefore, the amount of S to be contained is set as equal to or less than 0.03% and the lower limit of the amount to be contained is 0%.

Al: 0.3 to 5%

Al is the most important element of the present invention. When Al is contained at an amount equal to or greater than 0.3%, the concentration of oxygen in molten steel is increased. Therefore, the number of Al-containing oxides in steel after the solidification can increase. However, when Al is extremely contained at an amount greater than 5%, the effect of increasing fine Al-containing oxides by an addition of Al is saturated. Therefore, not only the addition of Al is wasteful but also toughness of the steel product is decreased. Accordingly, the amount of Al is 0.3 to 5%, and preferably 1.8 to 4.8%.

O: 0.003 to 0.01%

O in steel is an important element for generating a large amount of fine oxides. As described above, 0 combines with Al to generate Al-containing oxides, and thereby contributes to refinement of γ grains. The effect is obtained when an amount of O is 0.003% or more. When O is contained at an amount greater than 0.01%, coarse oxides are generated in steel. Therefore, toughness of the steel product deteriorates. Accordingly, the amount of O is 0.003 to 0.01%, and preferably 0.005 to 0.009%.

N: 0.006% or less

When N is contained in an amount greater than 0.006%, coarse AlN is generated in steel. Therefore, the toughness of the steel product deteriorates. Accordingly, the amount of N to be contained is set as equal to or less than 0.06% and the lower limit of the amount to be contained is 0%.

The basic composition of the steel of the present invention contains the above-mentioned elements and the balance composed of Fe and inevitable impurities.

In addition, in order to improve the toughness of a steel product, it is preferable that it contain Cu and/or Ni.

Cu: 0.3 to 2%

Cu in steel improves the toughness of the steel product. The effect is obtained when the steel product contains Cu in an amount equal to or more than 0.3%. The effect is saturated even when Cu exceeds 2%. Accordingly, the amount of Cu is set to 0.3 to 2%.

Ni: 0.3 to 2%

Ni in steel improves the toughness of the steel product. The effect is obtained when the steel product contains Ni in an amount equal to or more than 0.3%. The effect is saturated even when Ni exceeds 2%. Accordingly, the amount of Ni is set to 0.3 to 2%.

The above-described compositions are achieved by being adjusted in a usual manner in a molten steel stage before casting is started.

For example, generally, Al can be contained in steel by adding Al or an Al-containing alloy to the molten steel when the molten steel is tapped out from a converter or secondary refining is performed. O can be contained in steel by adding an oxygen-containing material such as iron ore to the molten steel, blowing an oxygen gas into the molten steel or spraying an oxygen gas to the surface of the molten steel.

Next, an amount of generated fine Al-containing oxides will be described.

FIG. 1 shows the influence of the number of Al-containing oxides having a size of 0.005 to 0.05 μm on the diameter of γ grains when the steel shown in Table 1 is held at 1400° C. for 60 seconds. In the present invention, the number of Al-containing oxides having a size less than 0.005 μm or more than 0.05 μm is very small. Therefore, these oxides are considered not to contribute to the suppression of the growth of γ grains.

Accordingly, the number of Al-containing oxides was calculated with the use of Al-containing oxides having a size of 0.005 to 0.05 μm.

The above-described heating condition (holding at 1400° C. for 60 seconds) corresponds to a condition of the HAZ near a fusion line when an 80 mm-thick steel product is subjected to electroslag welding with a welding heat input amount of about 100 kJ/mm.

As shown in FIG. 1, when the number of Al-containing oxides is less than $1\times10^6/mm^2$, the γ grain diameter is large and exceeds 60 μm. Accordingly, the HAZ structure is not sufficiently refined. Through a separate examination, it was confirmed that when the γ grain diameter exceeds 60 μm, excellent HAZ toughness cannot be obtained in ultra high heat input welding where the welding heat input amount exceeds 100 kJ/mm.

Thus, it is necessary to disperse Al-containing oxides having a size of 0.005 to 0.05 μm at a ratio of $1\times10^6/mm^2$ or more in steel in order to obtain a steel product for welding which has excellent HAZ toughness even in ultra high heat input welding where the welding heat input amount exceeds 100 kJ/mm. It is preferable that Al-containing oxides having a size of 0.005 to 0.05 μm be dispersed at a ratio of $1.8\times10^6/mm^2$ or more.

The steel product according to the present invention is produced by the following method. First, in steel making in the steel industry, chemical components are adjusted so as to have predetermined values in the range of the present invention. Next, continuous casting is performed to prepare a cast slab. The cast slab is reheated and then a shape and a base material property are imparted to the steel product by rolling of the thick plate. The size of the cast slab prepared by continuous casting is not particularly considered. If necessary, the steel product is subjected to various heat treatments so as to control the base material property. Without reheating the cast slab, hot charge rolling may also be performed.

The dispersion state of the oxides determined in the present invention is quantitatively measured by using, for example, the following method.

The dispersion state of Al-containing oxides having a size of 0.005 to 0.05 μm is observed by using a transmission electron microscope (TEM) at ten to fifty thousand-fold magnification over an area of at least 1,000 $\mu m^2$ or more. The number of precipitated materials of sizes corresponding to the target size is measured through this observation and the number of precipitated materials per unit area is calculated. In the TEM observation, an extraction replica sample is prepared from an arbitrary position in the base steel product to be used.

In addition, the identification of Al-containing oxides is performed by a composition analysis using an energy dispersive X-ray spectrometry (EDS) attached to a TEM and a crystal structure analysis of an electron beam diffraction image by a TEM.

When performing the identification on all of the precipitated material to be measured as described above is complicated, the following simple procedure may be used.

First, the number of precipitated materials of sizes corresponding to the target size is measured by the above-described method. Then, at least ten of the precipitated materials are identified by the above method so as to calculate an existence ratio of Al-containing oxides. It is confirmed that if at least about ten precipitated materials are randomly selected, the value of the existence ratio of Al-containing oxides is a representative value.

The number of precipitated materials, which is initially measured, is multiplied by the existence ratio. When the carbides in steel interfere with the TEM observation, the Al-containing oxides and the carbides can be easily distinguished by a heat treatment of 500° C. or lower for the aggregation and coarsening of the carbides.

The oxides suppressing the growth of γ grains include aluminum and oxygen as main components. However, in some cases, a minute amount of Mg, Ca, Zr, Ti, and the like is included which is incorporated from slag or refractories. The effect of suppressing the growth of γ grains by these elements is the same as in the case of the Al-containing oxides. In general, both of the Al concentration and the oxygen concentration in Al-containing oxides are equal to or more than 40%.

First, steel ingots having chemical components shown in Table 1 were produced by using a vacuum melting furnace. Next, these steel ingots were heated at 1200° C. for one hour so as to perform hot rolling until the thicknesses were reduced to 30 mm from 120 mm. In welding the resulting steel plates, a simulated thermal cycle of ultra high heat input of 100 kJ/mm was applied and thus test specimens were prepared. Similarly, in welding the steel plates, a simulated thermal cycle of low heat input of 10 kJ/mm was applied and thus test specimens prepared. These test specimens were subjected to a Charpy test at −40° C. so as to obtain absorbed energies vE (−40° C.).

In order to compare in HAZ toughness, the difference ΔvE (−40° C.) between Charpy absorbed energies vE (40° C.) of the test specimens to which the simulated thermal cycle corresponding to the welding heat input amounts of 100 kJ/mm and the simulated thermal cycle corresponding to the welding heat input amounts of 10 kJ/mm were applied was obtained.

Numbers 1 to 3 shown in Table 1 are examples according to the present invention. Al-containing oxides having a size of 0.005 to 0.05 μm were dispersed at a ratio of $1\times10^6/mm^2$ or more in steel. In these steel products, ΔvE (−40° C.) was 9 kJ/mm at most. Accordingly, it was found that even in ultra high heat input welding where the welding heat input amount was 100 kJ/mm, sufficient HAZ toughness of the same level as in low heat input welding, where the welding heat input amount was 10 kJ/mm, is ensured.

Numbers 4 to 8 are also examples according to the present invention. Al-containing oxides having a size of 0.005 to 0.05 μm were dispersed at a ratio of $1\times10^6/mm^2$ or more in steel. In these steel products, ΔvE (−40° C.) was 9 kJ/mm at most. Accordingly, it was found that even in ultra high heat input welding where the welding heat input amount was 100 kJ/mm, sufficient HAZ toughness of the same level as in low heat input welding where the welding heat input amount was 10 kJ/mm, is ensured.

Numbers 9 to 11 are comparative examples. In these steel products, the number of Al-containing oxides having a size of 0.005 to 0.05 μm in steel was less than $1\times10^6/mm^2$ because the amount of Al was smaller than the range of the present invention. Further, ΔvE (−40° C.) was 60 kJ/mm or more and larger than in the steel products of the examples according to the present invention. That is, in comparison with low heat input welding where the welding heat input amount was 10 kJ/mm, the HAZ toughness markedly deteriorated due to ultra high heat input welding where the welding heat input amount was 100 kJ/mm. Accordingly, in these comparison examples, the HAZ toughness was unsatisfactory.

Numbers 12 and 13 are comparative examples. In these steel products, the number of Al-containing oxides having a size of 0.005 to 0.05 μm satisfied the range of the present invention. However, in comparison with low heat input welding where the welding heat input amount was 10 kJ/mm, the HAZ toughness markedly deteriorated due to ultra high heat input welding where the welding heat input amount was 100 kJ/mm It is considered that the reason the HAZ toughness after the ultra high heat input welding markedly deteriorated is that the amount of Al deteriorating the toughness was larger than the range of the present invention. Accordingly, in these comparison examples, the HAZ toughness was unsatisfactory.

(Table 1)

TABLE 1

| Classification | Steel | Chemical Composition (mass %) C | Si | Mn | P | S | Al | O | N | Cu | Ni | Number of Al-containing Oxides Having Size of 0.005 to 0.05 μm /mm$^2$ | Toughness Deterioration in HAZ[1)] J/cm$^2$ |
|---|---|---|---|---|---|---|---|---|---|---|---|---|---|
| Example | 1 | 0.08 | 0.20 | 1.2 | 0.020 | 0.020 | 0.4 | 0.0040 | 0.0040 | | | $1.2 \times 10^6$ | 8 |
| | 2 | 0.15 | 0.50 | 1.5 | 0.025 | 0.010 | 1.8 | 0.0050 | 0.0050 | | | $1.8 \times 10^6$ | 9 |
| | 3 | 0.02 | 0.02 | 0.4 | 0.010 | 0.005 | 4.5 | 0.0085 | 0.0025 | | | $4.5 \times 10^6$ | 5 |
| | 4 | 0.10 | 0.20 | 1.5 | 0.008 | 0.004 | 0.3 | 0.0035 | 0.0045 | 0.3 | | $1.0 \times 10^6$ | 10 |
| | 5 | 0.06 | 0.12 | 0.8 | 0.010 | 0.006 | 1.0 | 0.0045 | 0.0030 | | 0.3 | $1.5 \times 10^6$ | 8 |
| | 6 | 0.25 | 0.08 | 1.2 | 0.012 | 0.015 | 4.8 | 0.0082 | 0.0055 | 2.0 | | $4.2 \times 10^6$ | 5 |
| | 7 | 0.15 | 0.20 | 0.4 | 0.005 | 0.005 | 2.0 | 0.0055 | 0.0050 | | 1.9 | $2.8 \times 10^6$ | 10 |
| | 8 | 0.03 | 0.02 | 0.4 | 0.010 | 0.005 | 4.5 | 0.0080 | 0.0025 | 0.6 | 0.3 | $4.0 \times 10^6$ | 5 |
| Comparative Example | 9 | 0.08 | 0.08 | 1.5 | 0.010 | 0.005 | 0.03 | 0.0025 | 0.0040 | | | $0.01 \times 10^4$ | 70 |
| | 10 | 0.12 | 0.20 | 0.8 | 0.006 | 0.003 | 0.1 | 0.0030 | 0.0040 | | | $0.1 \times 10^6$ | 65 |
| | 11 | 0.06 | 0.06 | 1.4 | 0.005 | 0.010 | 0.2 | 0.0035 | 0.0035 | | | $0.5 \times 10^6$ | 60 |
| | 12 | 0.06 | 0.24 | 2.0 | 0.020 | 0.025 | 6.0 | 0.0066 | 0.0025 | | | $4.0 \times 10^6$ | 20 |
| | 13 | 0.10 | 0.11 | 2.0 | 0.012 | 0.007 | 9.0 | 0.0080 | 0.0080 | | | $4.5 \times 10^6$ | 25 |

[1)]The difference ΔvE (−40° C.) between vE (−40° C.) when the welding heat input amount is 10 kJ/mm and vE (−40° C.) when the welding heat input amount is 100 kJ/mm is a V notch Charpy absorbed energy difference at −40° C.

While preferred embodiments of the present invention have been described and illustrated above, it should be understood that these are exemplary of the present invention and are not to be considered as limiting. Additions, omissions, substitutions, and other modifications can be made without departing from the scope of the present invention. Accordingly, the present invention is not to be considered as being limited by the foregoing description, and is only limited by the scope of the appended claims.

It is possible to provide a steel product for welding which has excellent toughness in a heat affected zone.

What is claimed is:

1. A steel product for welding comprising the following component:

by mass %,

C: 0.3% or less,

Si: 0.5% or less,

Mn: 0.3~2%,

P: 0.03% or less,

S: 0.03% or less,

Al: 0.3~5%,

O: 0.003~0.01%, and

N: 0.006% or less;

wherein the balance is composed of Fe and inevitable impurities;

wherein Al-containing oxides having a size of 0.005 to 0.05 μm are dispersed in steel at a ratio of $1\times10^6/mm^2$ or more.

2. The steel product for welding according to claim 1, wherein the steel product for welding comprising one or more of the following component:

by mass %,

Cu: 0.3~2%, and

Ni: 0.3~2%.

* * * * *